US011965701B2

(12) United States Patent
Yatsuyanagi et al.

(10) Patent No.: US 11,965,701 B2
(45) Date of Patent: Apr. 23, 2024

(54) HEAT EXCHANGER AND REFRIGERATION CYCLE APPARATUS

(71) Applicant: Mitsubishi Electric Corporation, Tokyo (JP)

(72) Inventors: Akira Yatsuyanagi, Tokyo (JP); Tsuyoshi Maeda, Tokyo (JP); Akira Ishibashi, Tokyo (JP); Atsushi Morita, Tokyo (JP); Shin Nakamura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 339 days.

(21) Appl. No.: 17/615,199

(22) PCT Filed: Aug. 6, 2019

(86) PCT No.: PCT/JP2019/030927
§ 371 (c)(1),
(2) Date: Nov. 30, 2021

(87) PCT Pub. No.: WO2021/024387
PCT Pub. Date: Feb. 11, 2021

(65) Prior Publication Data

US 2022/0228818 A1 Jul. 21, 2022

(51) Int. Cl.
*F28F 1/32* (2006.01)
*F28D 1/04* (2006.01)

(52) U.S. Cl.
CPC ..... *F28F 1/32* (2013.01); *F28D 1/04* (2013.01); *F28F 2210/08* (2013.01)

(58) Field of Classification Search
CPC ..... F28F 1/32; F28F 2210/08; F28D 1/04; F28D 1/047; F28D 1/053
(Continued)

(56) References Cited

U.S. PATENT DOCUMENTS 2,006,649 A * 7/1935 Modine ..... F28F 1/32 165/181
5,318,112 A * 6/1994 Gopin ..... F28F 13/12 165/910
(Continued)

FOREIGN PATENT DOCUMENTS

JP 2000-274982 A 10/2000
JP 2001-091183 A 4/2001
(Continued)

OTHER PUBLICATIONS

International Search Report of the International Searching Authority dated Oct. 8, 2019 for the corresponding International application No. PCT/JP2019/030927 (and English translation).
(Continued)

*Primary Examiner* — Tho V Duong
(74) *Attorney, Agent, or Firm* — POSZ LAW GROUP, PLC

(57) ABSTRACT

In a heat exchanger, an outer diameter of a plurality of heat transfer pipes is defined as Do, a wall thickness is defined as tP, an area represented by a numerical expression of a row pitch L1×a step pitch L2 is defined as A, and an area represented by a numerical expression of $((Do-2\times tP)/2)^2\times\pi$ is defined as B, a relation of Do<5.5 mm, a relation of $(0.2076\times tP^2-0.1480\times tP+0.0545)\times Do\hat{}(-0.0021\times tP^2-0.0528\times tP+0.0164)\leq B/A\leq(0.0219\times tP^2-0.0185\times tP+0.0043)\times \ln(Do)+(1.6950\times tP^2+1.8455\times tP+1.5416)$, and a relation of $B/A<0.0076\times tP^2-0.0417\times tP+0.0574$ are satisfied.

3 Claims, 12 Drawing Sheets

(58) Field of Classification Search
USPC ..... 165/148
See application file for complete search history.

(56) References Cited

U.S. PATENT DOCUMENTS

| | | | | |
|---|---|---|---|---|
| 6,997,248 | B2 * | 2/2006 | Shabtay | F28F 1/325 165/910 |
| 7,428,374 | B2 * | 9/2008 | Franke | F22B 1/1815 392/396 |
| 8,517,180 | B2 * | 8/2013 | Raichle | B07B 1/469 209/397 |
| 2015/0053377 | A1 * | 2/2015 | Hara | B23P 15/26 29/890.046 |
| 2019/0170451 | A1 | 6/2019 | Yokozeki et al. | |
| 2020/0300482 | A1 | 9/2020 | Kim | |

FOREIGN PATENT DOCUMENTS

| | | | |
|---|---|---|---|
| JP | 2003-021485 | A | 1/2003 |
| JP | 2011-237047 | A | 11/2011 |
| JP | 2013-092306 | A | 5/2013 |
| JP | 2017-166757 | A | 9/2017 |

OTHER PUBLICATIONS

Examination Report dated Jun. 21, 2022 issued in corresponding IN patent application No. 202227005242.
Extended European Search Report dated Jul. 4, 2022 issued in corresponding European patent application No. 19940370.0.

* cited by examiner

HEAT EXCHANGER AND REFRIGERATION CYCLE APPARATUS

CROSS REFERENCE TO RELATED APPLICATION

This application is a U.S. national stage application of PCT/JP2019/030927 filed on Aug. 6, 2019, the contents of which are incorporated herein by reference.

TECHNICAL FIELD

The present disclosure relates to a heat exchanger including a plurality of fins and a plurality of heat transfer pipes each extending in a direction intersecting the plurality of fins and to a refrigeration cycle apparatus including the same.

BACKGROUND

Patent Literature 1 discloses a heat exchanger including a plurality of fins arranged parallel to each other to form a flow passage of gas and heat transfer pipes each passing through the plurality of fins and through which a medium that exchanges heat with the gas flows. The plurality of fins each have a plurality of through-holes and the heat transfer pipes are fitted separately in the plurality of respective through-holes. The plurality of through-holes are provided at equal intervals along a step direction perpendicular to both a direction in which the plurality of fins are arranged and a direction of flow of the gas, and are provided in a plurality of rows along a row direction parallel to the direction of flow of the gas.

PATENT LITERATURE

Patent Literature 1: Japanese Unexamined Patent Application Publication No. 2013-92306

The heat exchanger of Patent Literature 1 is a part of a refrigeration cycle apparatus such as an air-conditioning apparatus. There has recently been a demand for a reduction in amount of refrigerant charge to reduce the total value of GWP of a refrigeration cycle apparatus. A possible way of reducing the amount of refrigerant charge in a refrigeration cycle apparatus is to reduce the inner capacity of each of the heat transfer pipes of the heat exchanger by reducing the pipe diameter of each of the heat transfer pipes. However, reducing the pipe diameter of each of the heat transfer pipes usually causes a decrease in heat transfer performance of the heat exchanger. For this reason, to maintain the heat transfer performance of the heat exchanger while reducing the pipe diameter of each of the heat transfer pipes, it is necessary to narrow the intervals at which the fins are placed and increase the number of rows of the heat transfer pipes. Meanwhile, narrowing the intervals at which the fins are placed and increasing the number of rows of the heat transfer pipes result in deterioration in ventilation performance of the heat exchanger. That is, there is a trade-off between heat transfer performance and ventilation performance in a heat exchanger whose heat transfer pipes each have a reduced inner capacity. Heat transfer performance and ventilation performance both affect the heat exchanger performance of a heat exchanger. Accordingly, it has been undesirably difficult to improve the heat exchanger performance of a heat exchanger while reducing the inner capacity of each of the heat transfer pipes.

SUMMARY

The present disclosure has been made to solve such a problem, and has as an object to provide a heat exchanger that makes it possible to improve the heat exchanger performance of the heat exchanger while reducing the inner capacity of heat transfer pipes and a refrigeration cycle apparatus including the same.

A heat exchanger according to an embodiment of the present disclosure includes a plurality of fins arranged in parallel to each other and a plurality of heat transfer pipes each extending in a direction intersecting the plurality of fins. In a plane perpendicular to a direction in which the plurality of heat transfer pipes extend, the plurality of heat transfer pipes are placed in a plurality of rows in a row direction that is along a direction of airflow at a row pitch L1. In the plane, the plurality of heat transfer pipes are placed in a plurality of steps in a step direction perpendicular to the row direction at a step pitch L2. Where an outer diameter of each of the plurality of heat transfer pipes is defined as Do, a wall thickness of a portion having a smallest distance between an outer wall surface and an inner wall surface of each of the plurality of heat transfer pipes is defined as tP, an area represented by a numerical expression of L1×L2 is defined as A, and an area represented by a numerical expression of $((Do-2\times tP)/2)^2\times\pi$ is defined as B, a relation of $Do<5.5$ mm, a relation of $(0.2076\times tP^2-0.1480\times tP+0.0545)\times Do\hat{}(-0.0021\times tP^2-0.0528\times tP+0.0164)\leq B/A\leq(0.0219\times tP^2-0.0185\times tP+0.0043)\times \ln(Do)+(1.6950\times tP^2+1.8455\times tP+1.5416)$, and a relation of $B/A<0.0076\times tP^2-0.0417\times tP+0.0574$ are satisfied.

A refrigeration cycle apparatus according to another embodiment of the present disclosure includes the heat exchanger according to an embodiment of the present disclosure.

An embodiment of the present disclosure makes it possible to improve the heat exchanger performance of a heat exchanger while reducing the inner capacity of heat transfer pipes.

DETAILED DESCRIPTION

Embodiment 1

Figure 1:
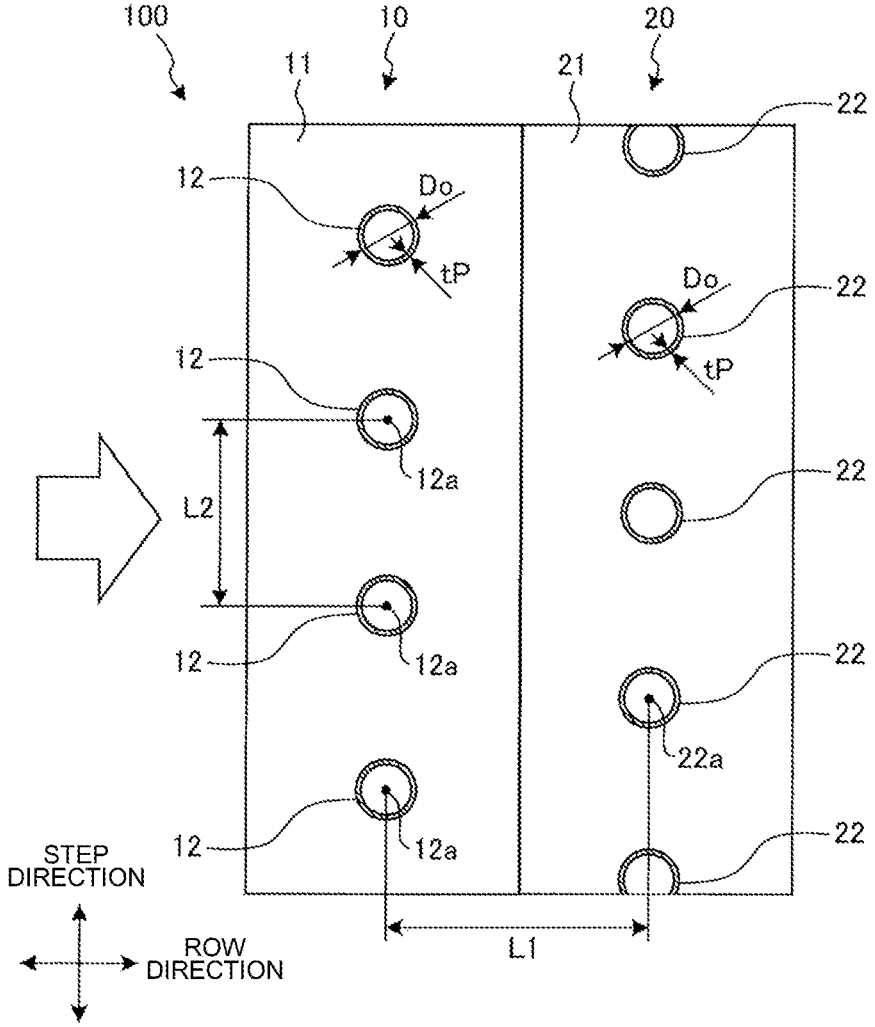
FIG. 1 is a cross-sectional view showing a configuration of some components of a heat exchanger 100 according to Embodiment 1.

A heat exchanger according to Embodiment 1 is described. FIG. 1 is a cross-sectional view showing a configuration of some components of a heat exchanger 100 according to Embodiment 1. FIG. 1 shows a configuration of the heat exchanger 100 as sectioned along a plane perpendicular to a direction in which the after-mentioned first heat transfer pipes 12 extend. The heat exchanger 100 is used as a heat source side heat exchanger or a load side heat exchanger of a refrigeration cycle apparatus. The heat exchanger 100 is a cross-fin fin-and-tube heat exchanger that allows refrigerant circulating through the heat transfer pipes and air to exchange heat with each other. A usable example of the refrigerant include a hydrofluorocarbon such as R410, R407C, and R32, isobutane, propane, and carbon dioxide. In FIG. 1, a thick arrow outline with a blank inside represents a direction of airflow.

As shown in FIG. 1, the heat exchanger 100 includes, as a plurality of heat exchange units arrayed along the direction of airflow, a first heat exchange unit 10 located furthest windward and a second heat exchange unit 20 located further leeward than the first heat exchange unit 10.

The first heat exchange unit 10 includes a plurality of first fins 11 arranged parallel to each other at intervals and a plurality of first heat transfer pipes 12 each passing through the plurality of first fins 11 and each extending parallel to each other in a direction intersecting the plurality of first fins 11. Each of the plurality of first fins 11 has a rectangular flat-plate shape elongated in one direction. Each of the plurality of first fins 11 is placed perpendicular to a direction in which the first heat transfer pipes 12 extend. The plurality of first fins 11 are provided parallel to each other at regular placement pitches in a direction perpendicular to a surface of paper of FIG. 1, that is, the direction in which the first heat transfer pipes 12 extend. A gap between two first fins 11 adjacent to each other serves as air passageway through which air circulates. Note here that a direction that is along the direction of airflow in a plane perpendicular to the direction in which the first heat transfer pipes 12 extend is sometimes referred to as "row direction of the heat exchanger 100" or simply as "row direction". Further, a direction perpendicular to the row direction in the plane is sometimes referred to as "step direction of the heat exchanger 100" or simply as "step direction". The step direction of the heat exchanger 100 is parallel to, for example, a longitudinal direction of each of the first fins 11 and a longitudinal direction of each of the after-mentioned second fins 21.

Each of the plurality of first heat transfer pipes 12 extends in the direction perpendicular to the surface of paper of FIG. 1. The plurality of first heat transfer pipes 12 are arrayed at regular step pitches L2 in one row in the step direction of the heat exchanger 100. Each of the step pitches can be specified by a distance in the step direction between the respective tube axes 12*a* of two first heat transfer pipes 12 adjacent to each other in the step direction. Each of the plurality of first heat transfer pipes 12 is a circular pipe having an outer diameter Do. Further, each of the plurality of first heat transfer pipes 12 is a circular pipe having a wall thickness tP of a portion having a smallest distance between an outer wall surface and an inner wall surface. The plurality of first heat transfer pipes 12 constitute a first row of heat transfer pipes located furthest windward in the heat exchanger 100.

The second heat exchange unit 20 includes a plurality of second fins 21 arranged parallel to each other at intervals and a plurality of second heat transfer pipes 22 each passing through the plurality of second fins 21 and each extending parallel to each other in a direction intersecting the plurality of second fins 21. As with the first fins 11, each of the plurality of second fins 21 has a rectangular flat-plate shape. Each of the plurality of second fins 21 is placed parallel to the first fins 11 and perpendicular to a direction in which the second heat transfer pipes 22 extend. The plurality of second fins 21 are provided parallel to each other at regular placement pitches in the direction perpendicular to the surface of paper of FIG. 1, that is, the direction in which the first heat transfer pipes 12 extend. Each of the plurality of second fins 21 is placed with a displacement of, for example, approximately half a pitch from the corresponding one of the plurality of first fins 11. A gap between two second fins 21 adjacent to each other serves as an air passageway. In the present embodiment, each of the first fins 11 and each of the second fins 21 are separate components. Alternatively, the first fin 11 and the second fin 21 may be integrally formed. That is, the first heat exchange unit 10 and the second heat exchange unit may share a plurality of fins with each other.

Each of the plurality of second heat transfer pipes 22 extends in a direction parallel to the direction in which the first heat transfer pipes 12 extend. The plurality of second heat transfer pipes 22 are arrayed at step pitches L2 in one row in the step direction of the heat exchanger 100. Each of the step pitches L2 is equal to a step pitch between first heat transfer pipes 12. Each of the plurality of second heat transfer pipes 22 is placed with a displacement of, for example, approximately half a pitch from the corresponding one of the plurality of first heat transfer pipes 12. The plurality of second heat transfer pipes 22 constitute a second row of heat transfer pipes as counted from a windward side in the heat exchanger 100. The plurality of first heat transfer pipes 12 and the plurality of second heat transfer pipes 22 are arrayed at row pitches L1 in the row direction of the heat exchanger 100. Each of the row pitches can be specified by a distance in the row direction between the tube axis 12*a* of a first heat transfer pipe 12 and a tube axis 22*a* of a second heat transfer pipe 22. A row pitch between first heat transfer pipes 12 in the first heat exchange unit 10 and a row pitch between second heat transfer pipes 22 in the second heat exchange unit 20 can both be considered as L1. Each of the plurality of second heat transfer pipes 22 is a circular pipe having an outer diameter Do that is equal to the outer diameter of a first heat transfer pipe 12. Further, each of the plurality of second heat transfer pipes 22 is a circular pipe having a wall thickness tP that is equal to the wall thickness of a first heat transfer pipe 12. The heat exchanger 100 includes a plurality of refrigerant paths (not illustrated) connected parallel to each other in a flow passage of refrigerant. Each of the plurality of refrigerant paths is formed using one or more first heat transfer pipes 12, one or more second heat transfer pipes 22, or a combination of one or more first heat transfer pipes 12 and one or more second heat transfer pipes 22.

Figure 2:
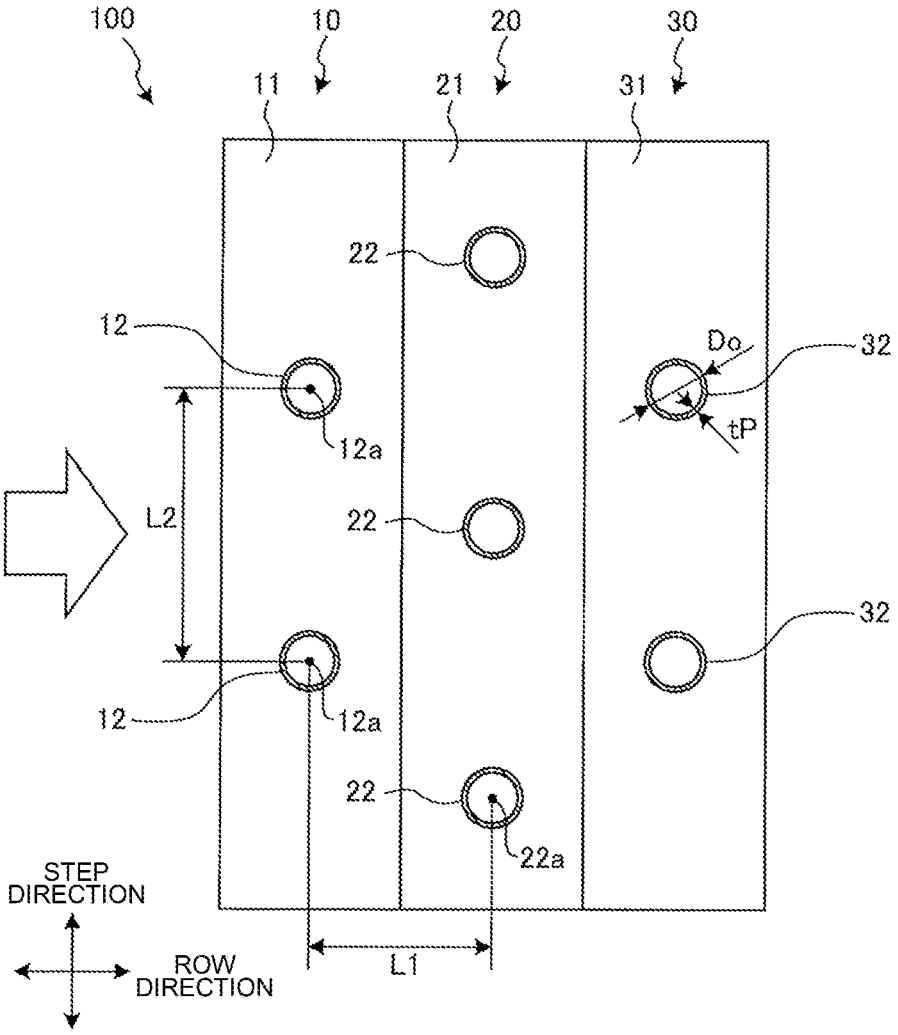
FIG. 2 is a cross-sectional view showing a configuration of some components of a heat exchanger 100 according to a modification of Embodiment 1.

FIG. 2 is a cross-sectional view showing a configuration of some components of a heat exchanger 100 according to a modification of Embodiment 1. As with FIG. 1, FIG. 2 shows a configuration of the heat exchanger 100 as sectioned along the plane perpendicular to the direction in which the first heat transfer pipes 12 extend. As shown in FIG. 2, the heat exchanger 100 of the present modification differs from the heat exchanger 100 shown in FIG. 1 in that the heat exchanger 100 of the present modification includes another second heat exchange unit 30 located further leeward than the second heat exchange unit 20.

The second heat exchange unit 30 includes a plurality of second fins 31 and a plurality of second heat transfer pipes 32 each passing through the plurality of second fins 31. As with the first fins 11 and the second fins 21, each of the plurality of second fins 31 has a rectangular flat-plate shape. Each of the plurality of second fins 31 is placed parallel to the first fins 11 and the second fins 21 and perpendicular to a direction in which the second heat transfer pipes 32 extend. The plurality of second fins 31 are provided parallel to each other at regular placement pitches in a direction perpendicular to a surface of paper of FIG. 2, that is, the direction in which the first heat transfer pipes 12 extend. A gap between two second fins 31 adjacent to each other serves as an air passageway. In the present embodiment, each of the first fins 11, each of the second fins 21, and each of the second fins 31 are separate components. Alternatively, at least two of the first fin 11, the second fin 21, and the second fin 31 may be integrally formed.

Each of the plurality of second heat transfer pipes 32 extends in the direction parallel to the direction in which the first heat transfer pipes 12 extend. The plurality of second heat transfer pipes 32 are arrayed at step pitches L2 in one row in the step direction of the heat exchanger 100. Each of the step pitches L2 is equal to a step pitch between first heat transfer pipes 12 and a step pitch between second heat transfer pipes 22. The plurality of second heat transfer pipes 32 constitute a third row of heat transfer pipes as counted from the windward side in the heat exchanger 100. The plurality of first heat transfer pipes 12, the plurality of second heat transfer pipes 22, and the plurality of second heat transfer pipes 32 are arrayed at row pitches L1 in the row direction of the heat exchanger 100. Each of the plurality of second heat transfer pipes 32 is a circular pipe having an outer diameter Do that is equal to the outer diameter of a first heat transfer pipe 12 and the outer diameter of a second heat transfer pipe 22. Further, each of the plurality of second heat transfer pipes 32 is a circular pipe having a wall thickness tP that is equal to the wall thickness of a first heat transfer pipe 12 and the wall thickness of a second heat transfer pipe 22.

In the present embodiment, the respective wall thicknesses tP of the first heat transfer pipes 12, the second heat transfer pipes 22, and the second heat transfer pipes 32 each range, for example, from 0.1 to 0.4 mm. Note, however, that the respective wall thicknesses of the first heat transfer pipes 12, the second heat transfer pipes 22, and the second heat transfer pipes 32 may be each less than 0.1 mm or may be each greater than 0.4 mm.

In a process of manufacturing the heat exchanger 100, the first heat transfer pipes 12, the second heat transfer pipes 22, and the second heat transfer pipes 32 may be subjected to pipe expanding. In this case, the respective outer diameters Do of the first heat transfer pipes 12, the second heat transfer pipes 22, and the second heat transfer pipes 32 may of course be specified by outer diameters after pipe expanding.

The following describes heat exchanger performance and cost performance in a case in which the outer diameters Do, the row pitches L1, the step pitches L2, and the wall thicknesses tP of the heat transfer pipes of the heat exchanger 100 are varied.

Table 1 is a table showing effects exerted on the intra-pipe volume V, the extra-pipe heat transfer coefficient αo, the ventilation resistance ΔP, the extra-pipe heat transfer area Ao, and the heat exchanger weight M in a case in which the outer diameters Do, the row pitches L1, the step pitches L2, and the wall thicknesses tP of the heat transfer pipes of the heat exchanger 100 according to the present embodiment are varied. It should be noted, in Table 1, when each of the parameters, namely the outer diameters Do, the row pitches L1, the step pitches L2, and the wall thicknesses tP of the heat transfer pipes, are varied, the other parameters are fixed.

TABLE 1

| | Direction of change | V | αo | ΔP | Ao | M |
|---|---|---|---|---|---|---|
| Do | increase | + | + | + | − | + |
| | Decrease | − | − | − | + | − |
| L1 (Row) | increase | Unchanged | − | + | + | + |
| | Decrease | Unchanged | + | − | − | − |

TABLE 1-continued

| | Direction of change | V | αo | ΔP | Ao | M |
|---|---|---|---|---|---|---|
| L2 (Step) | increase | − | − | − | + | − |
| | Decrease | + | + | + | − | + |
| tP | increase | − | Unchanged | Unchanged | Unchanged | + |
| | Decrease | + | Unchanged | Unchanged | Unchanged | − |

The intra-pipe volume V [$m^3$] is a value obtained by multiplying the cross-sectional area of an interior channel of one heat transfer pipe by the length of the heat transfer pipe. The extra-pipe heat transfer coefficient αo [$W/m^2 \cdot K$] is the proportion of the amount of heat that is transferred between an outer wall surface of a heat transfer pipe and air. The ventilation resistance ΔP [Pa] is a pressure loss of air passing through the heat exchanger 100. The extra-pipe heat transfer area Ao [$m^2$] is the gross area of the respective outer wall surfaces of the heat transfer pipes of the heat exchanger 100. The heat exchanger weight M [kg] is the weight (core weight) of a heat exchange core unit of the heat exchanger 100 and the heat exchange core unit is formed by the heat transfer pipes and the fins.

In a case in which the outer diameter Do is reduced and the step pitch L2 is increased for the purpose of reducing the intra-pipe volume V, that is, the amount of refrigerant charge, the extra-pipe heat transfer coefficient αo decreases, so that energy-saving effectiveness decreases because of lack of heat transfer performance. Accordingly, for improving the heat transfer performance, it is necessary to increase the extra-pipe heat transfer area Ao by increasing the row pitch L1 or to increase the extra-pipe heat transfer coefficient αo by reducing the row pitch L1 and increase the extra-pipe heat transfer area Ao by increasing the number of rows of the heat transfer pipes. However, in either case, the amount of use of the fins or the heat transfer pipes increases, so that there is a possibility that cost performance, that is, the heat exchange performance of the heat exchanger 100 per unit weight, may decrease. Further, in a case in which the wall thickness tP of each of the heat transfer pipes is increased for the purpose of reducing the intra-pipe volume V, that is, the amount of refrigerant charge, the amount of use of the heat transfer pipes increases, so that there is a possibility that cost performance may similarly decrease. For these reasons, it is necessary to appropriately set the outer diameters Do, the row pitches L1, the step pitches L2, and the wall thicknesses tP of the heat transfer pipes of the heat exchanger 100 to achieve both a reduction in the intra-pipe volume V and an increase in cost performance of the heat exchanger 100.

The following describes the extra-pipe heat exchange performance of the heat exchanger 100 per unit weight.

FIGS. 3 to 6 each show a relationship between the area ratio of heat transfer pipes to fins and extra-pipe heat exchange performance per unit weight in the heat exchanger 100 according to Embodiment 1 as a ratio to a maximum value at Do=5.5 mm for each outer diameter Do (Do=2.0 mm, 3.0 mm, 4.0 mm, 5.0 mm, 5.5 mm) of the heat transfer pipes.

Note here that the heat transfer pipes may include first heat transfer pipes 12, second heat transfer pipes 22, and second heat transfer pipes 32. The fins may include first fins 11, second fins 21, and second fins 31. The area A is an area represented by the product L1×L2 of a row pitch L1 and a step pitch L2. The area A is equivalent to the area of each fin per heat transfer pipe. Also, the area B is an area represented by $((Do-2\times tP)/2)^2\times\pi$ using the outer diameter Do and wall thickness tP of each of the heat transfer pipes. The area B is equivalent to the cross-sectional area of an interior channel of one heat transfer pipe.

In each of FIGS. 3 to 6, the horizontal axis of the graph represents the area ratio B/A of the area B to the area A. The area ratio B/A represents, as an area ratio, the density at which the heat transfer pipes are placed through the fins. A relationship between the area ratio B/A and the intra-pipe volume V is described here. FIG. 7 is a graph showing a relationship between the area ratio B/A and the intra-pipe volume V in the heat exchanger 100 according to Embodiment 1. FIG. 7 shows effects of the area ratio B/A on the intra-pipe volume V in cases where Outer Diameter Do=3.0 mm and Do=5.5 mm and Wall Thickness tP=0.2 mm. As shown in FIG. 7, the intra-pipe volume V decreases as the area ratio B/A decreases.

In each of FIGS. 3 to 6, the vertical axis of the graph represents the extra-pipe heat transfer performance (Extra-pipe Heat Transfer Performance/Weight) of the heat exchanger 100 per unit weight as a ratio to a maximum value at Do=5.5 mm. The extra-pipe heat exchange performance is (Extra-pipe Heat Transfer Area Ao×Extra-pipe Heat Transfer Coefficient αo)/ΔP. Extra-pipe Heat Transfer Area Ao×Extra-pipe Heat Transfer Coefficient αo is the extra-pipe heat transfer performance.

A relationship between each of the extra-pipe heat transfer performance, the ventilation resistance ΔP, the heat exchanger weight M, and the extra-pipe heat exchange performance and the area ratio B/A is described here with reference to FIGS. 8 to 12.

Figure 8:
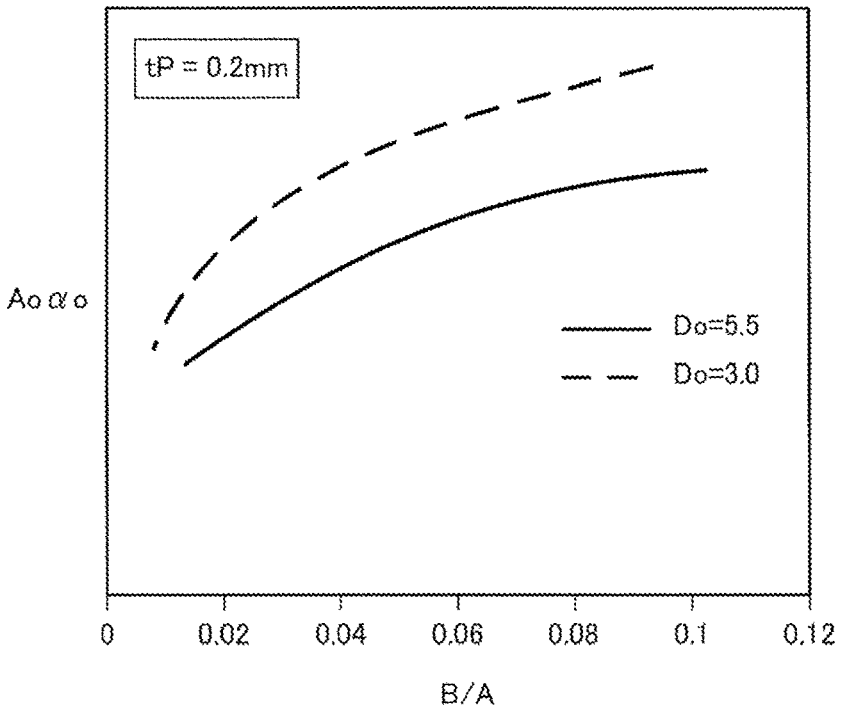
FIG. 8 is a graph showing a relationship between the area ratio B/A and the extra-pipe heat transfer performance (Ao×αo) in the heat exchanger 100 according to Embodiment 1.

FIG. 8 is a graph showing a relationship between the area ratio B/A and the extra-pipe heat transfer performance (Ao×αo) in the heat exchanger 100 according to Embodiment 1. FIG. 8 shows effects of the area ratio B/A on the extra-pipe heat transfer performance (Extra-pipe Heat Transfer Area Ao×Extra-pipe Heat Transfer Coefficient αo) in cases where Outer Diameter Do=3.0 mm and Do=5.5 mm and Wall Thickness tP=0.2 mm. As the area ratio B/A increases, the heat transfer pipes are located closer to each other and thermal conductivity improves, so that the extra-pipe heat transfer performance (Ao×αo) increases. Further, a comparison made at identical area ratios B/A shows that the extra-pipe heat transfer performance (Ao×αo) increases as the outer diameter Do of each of the heat transfer pipes decreases. A reason for this is that the heat transfer pipes are located closer to each other as the outer diameter Do of each of the heat transfer pipes decreases. For example, as shown in FIG. 8, a comparison made at identical area ratios B/A shows that the extra-pipe heat transfer performance (Ao×αo) is higher when Do=3.0 mm than when Do=5.5 mm. Further, as an example, in a case in which Area Ratio B/A=0.06, L1=L2=21.7 mm when Do=3.0 mm, and L1=L2=39.8 mm when Do=5.5. That is, the heat transfer pipes are located closer to each other in a case in which Do=3.0 mm than in a case in which Do=5.5 mm.

Figure 9:
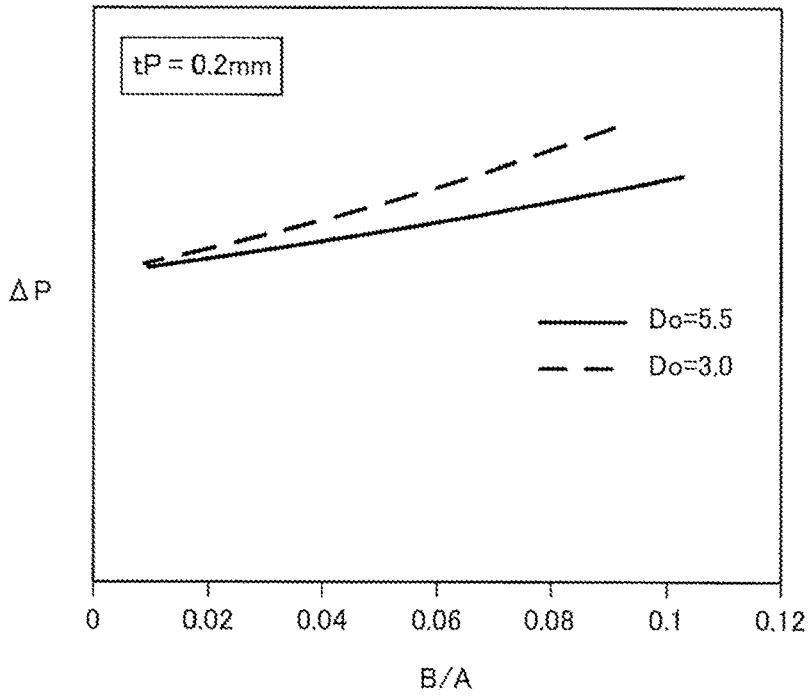
FIG. 9 is a graph showing a relationship between the area ratio B/A and the ventilation resistance ΔP in the heat exchanger 100 according to Embodiment 1.

FIG. 9 is a graph showing a relationship between the area ratio B/A and the ventilation resistance ΔP in the heat exchanger 100 according to Embodiment 1. FIG. 9 shows effects of the area ratio B/A on the ventilation resistance ΔP in cases where Outer Diameter Do=3.0 mm and Do=5.5 mm and Wall Thickness tP=0.2 mm. As the area ratio B/A increases, the heat transfer pipes are located closer to each other and resistance to the flow of air passing through the heat exchanger 100 increases, so that the ventilation resistance ΔP increases. In particular, the heat transfer pipes are located to closer to each other as the outer diameter Do of each of the heat transfer pipes decreases, with the same area ratio B/A. For this reason, when the area ratio B/A increases, those heat transfer pipes with a smaller outer diameter Do suffer from earlier closure of air trunks through which air circulates and from a higher rate of increase in the ventilation resistance ΔP than do those heat transfer pipes with a large outer diameter Do.

Figure 10:
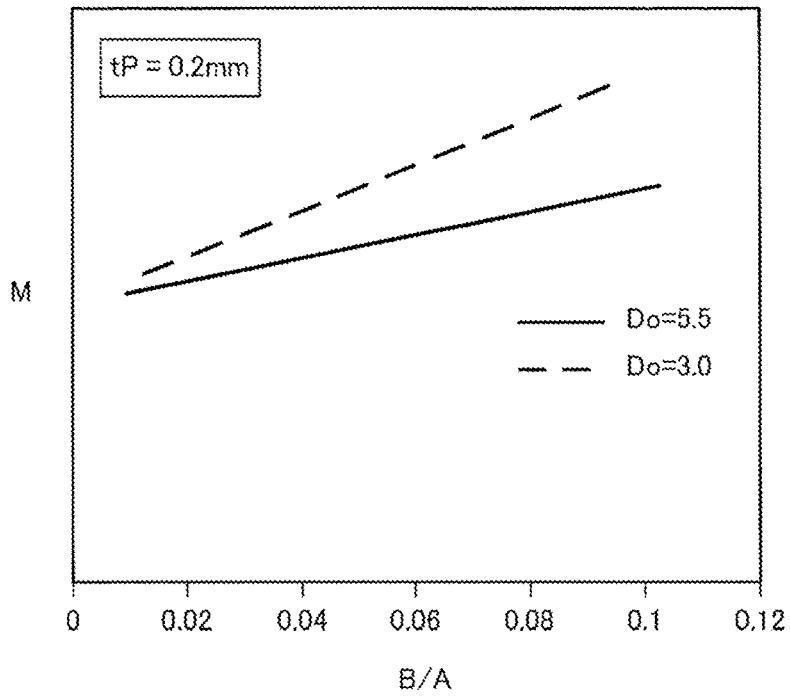
FIG. 10 is a graph showing a relationship between the area ratio B/A and the heat exchanger weight M in the heat exchanger 100 according to Embodiment 1.

FIG. 10 is a graph showing a relationship between the area ratio B/A and the heat exchanger weight M in the heat exchanger 100 according to Embodiment 1. FIG. 10 shows effects of the area ratio B/A on the heat exchanger weight M in cases where Outer Diameter Do=3.0 mm and Do=5.5 mm and Wall Thickness tP=0.2 mm. The value of the weight (core weight) of the heat exchanger 100 has a positive correlation with the amount of material of the heat exchanger 100 to be used and the manufacturing cost of the heat exchanger 100. For this reason, the value of Extra-pipe Heat Exchange Performance/Weight represented by the vertical axis of the graph in each of FIGS. 3 to 6 is equivalent to the cost performance of the heat exchanger 100. As the area ratio B/A decreases, the number of heat transfer pipes that are mounted in the heat exchanger 100 decreases, so that the heat exchanger weight M decreases.

Figure 11:
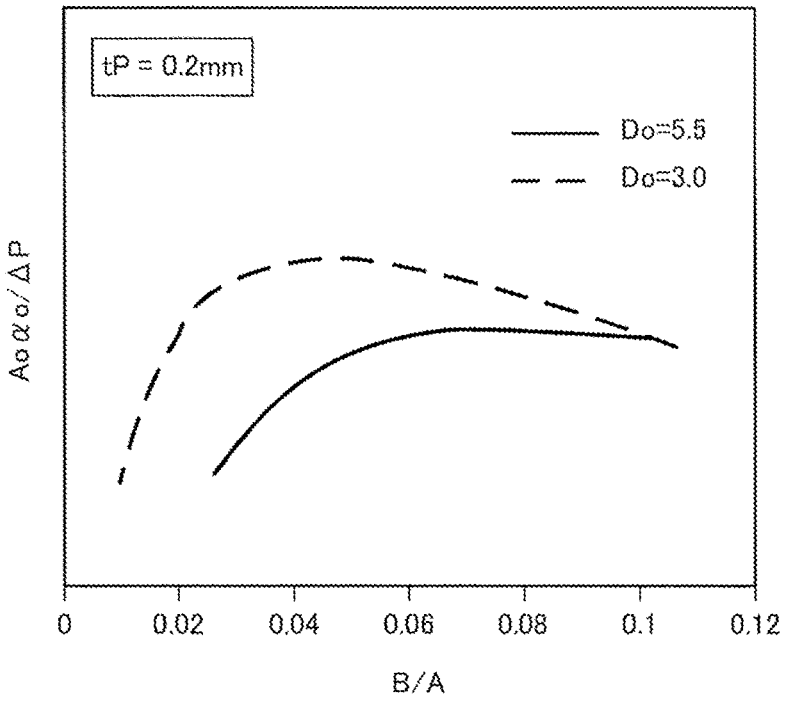
FIG. 11 is a graph showing a relationship between the area ratio B/A and the extra-pipe heat exchange performance in the heat exchanger 100 according to Embodiment 1.
Figure 12:
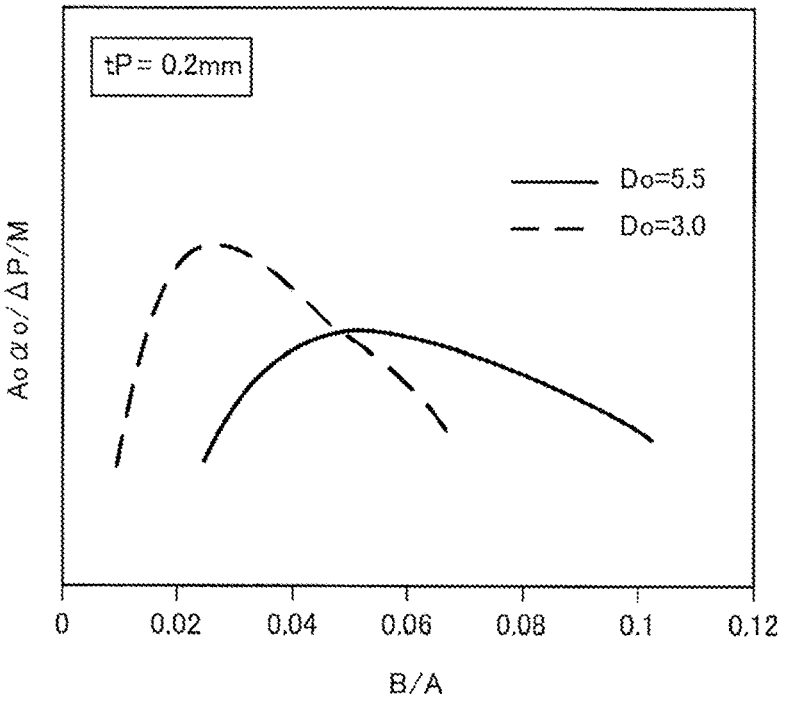
FIG. 12 is a graph showing a relationship between the area ratio B/A and the extra-pipe heat exchange performance per unit weight in the heat exchanger 100 according to Embodiment 1.

FIG. 11 is a graph showing a relationship between the area ratio B/A and the extra-pipe heat exchange performance in the heat exchanger 100 according to Embodiment 1. FIG. 11 shows effects of the area ratio B/A on the extra-pipe heat exchange performance ((Ao×αo)/ΔP) in cases where Outer Diameter Do=3.0 mm and Do=5.5 mm and Wall Thickness tP=0.2 mm. Further, FIG. 12 is a graph showing a relationship between the area ratio B/A and the extra-pipe heat exchange performance per unit weight in the heat exchanger 100 according to Embodiment 1. FIG. 12 shows effects of the area ratio B/A on the extra-pipe heat exchange performance per unit weight ((Ao×αo)/ΔP/M) in cases where Outer Diameter Do=3.0 mm and Do=5.5 mm and Wall Thickness tP=0.2 mm. As shown in FIG. 11, the characteristic of the extra-pipe heat exchange performance to the area ratio B/A has a maximum value. Further, as shown in FIG. 10, the heat exchanger weight M monotonically increases when the area ratio B/A increases. For this reason, as shown in FIG. 12, the characteristic of the extra-pipe heat exchange performance per unit weight to the area ratio B/A also has a maximum value. Further, as the area ratio B/A increases, the heat exchanger weight M increases, so that the extra-pipe heat exchange performance per unit weight has a lower gradient in a region in which the area ratio B/A is high. Further, as the outer diameter Do of each of the heat transfer pipes decreases, the rate of change in the ventilation resistance ΔP increases, so that the extra-pipe heat exchange performance per unit weight to the area ratio B/A having a maximum value is lower. Further, as shown in FIG. 11, the maximum value of the extra-pipe heat exchange performance ((Ao×αo)/ΔP) increases as the outer diameter Do of each of the heat transfer pipes decreases.

Figure 3:
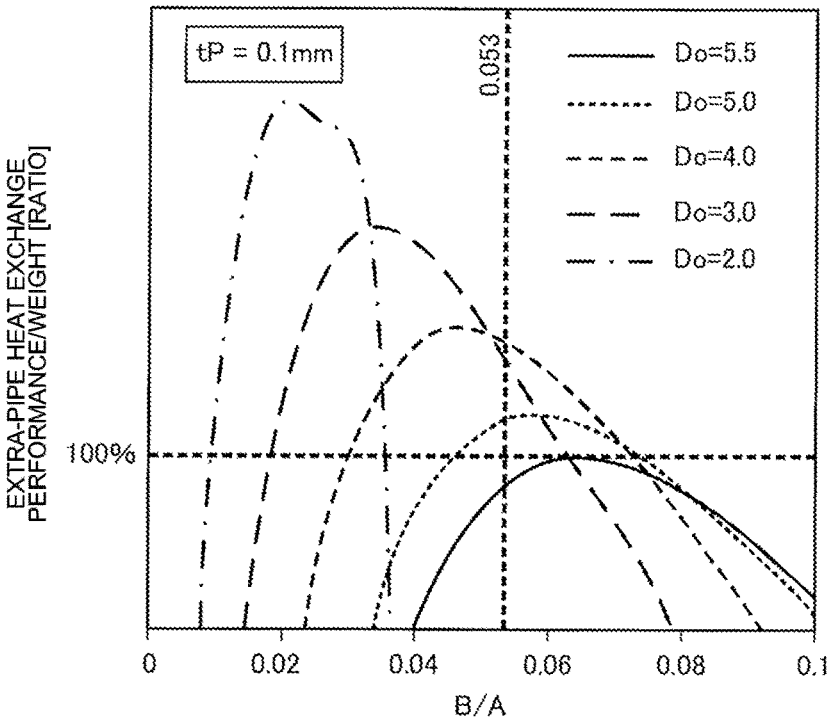
FIG. 3 is a graph showing a relationship between the area ratio of heat transfer pipes to fins and extra-pipe heat exchange performance per unit weight in the heat exchanger 100 according to Embodiment 1 for each outer diameter Do of the heat transfer pipes.
Figure 4:
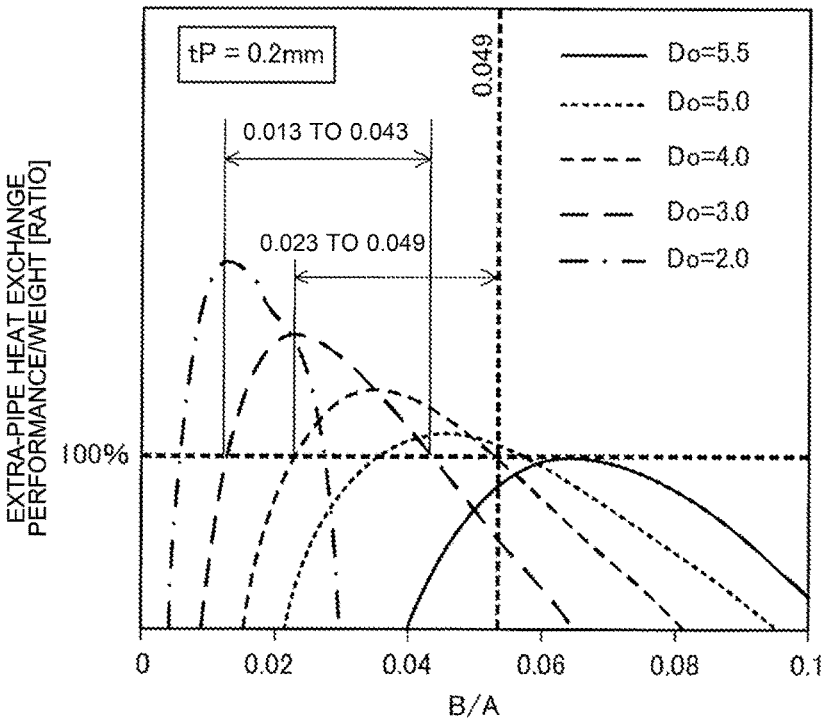
FIG. 4 is a graph showing a relationship between the area ratio of heat transfer pipes to fins and extra-pipe heat exchange performance per unit weight in the heat exchanger 100 according to Embodiment 1 for each outer diameter Do of the heat transfer pipes.
Figure 5:
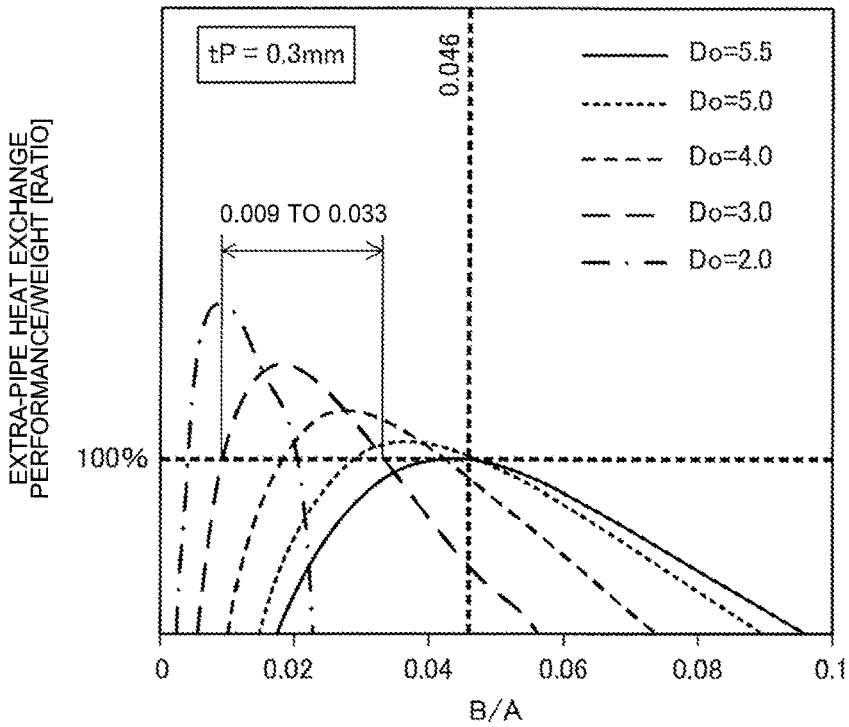
FIG. 5 is a graph showing a relationship between the area ratio of heat transfer pipes to fins and extra-pipe heat exchange performance per unit weight in the heat exchanger 100 according to Embodiment 1 for each outer diameter Do of the heat transfer pipes.
Figure 6:
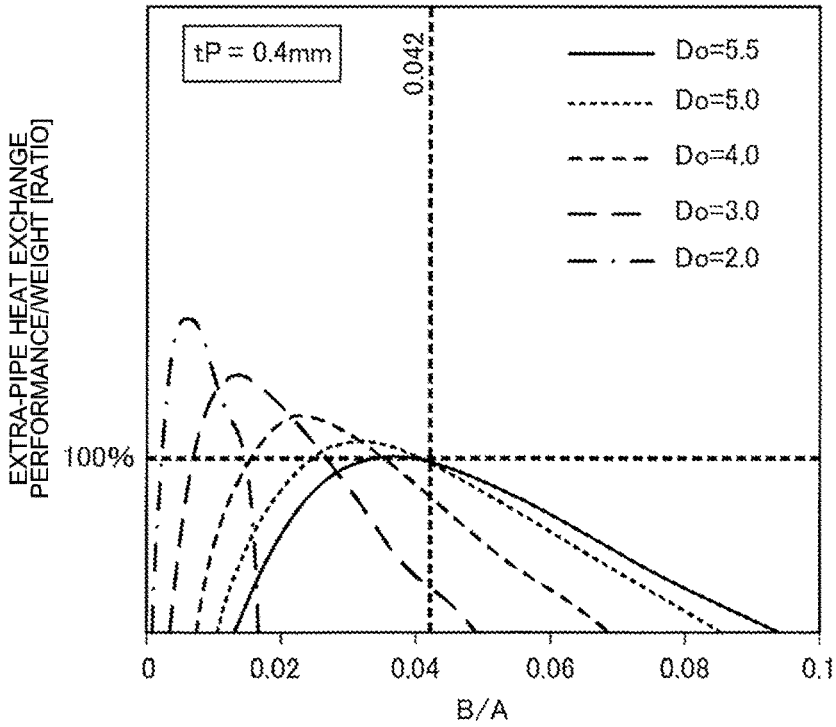
FIG. 6 is a graph showing a relationship between the area ratio of heat transfer pipes to fins and extra-pipe heat exchange performance per unit weight in the heat exchanger 100 according to Embodiment 1 for each outer diameter Do of the heat transfer pipes.
Figure 7:
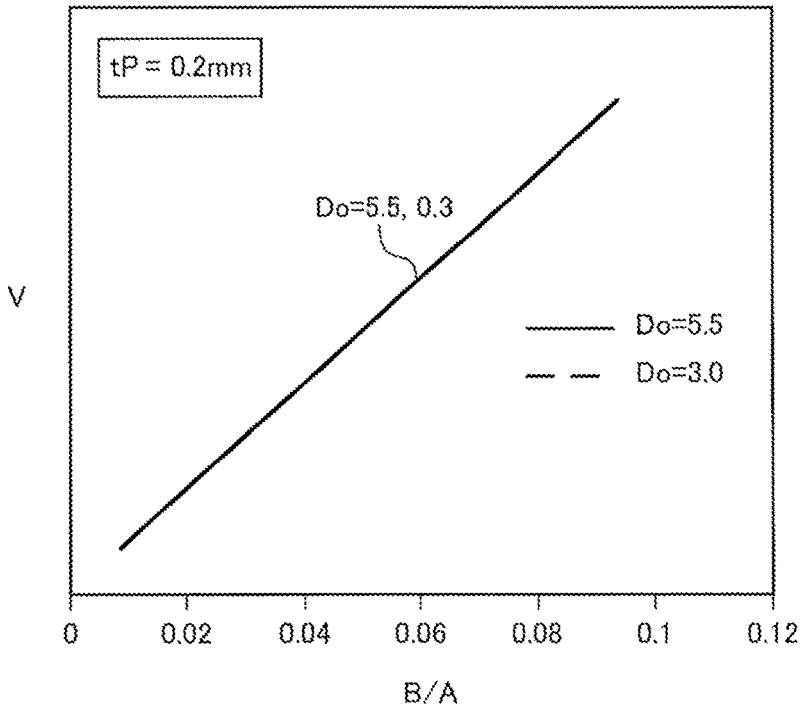
FIG. 7 is a graph showing a relationship between the area ratio B/A and the intra-pipe volume V in the heat exchanger 100 according to Embodiment 1.

Continued reference is made to FIGS. 3 to 6. FIGS. 3 to 6 vary in value of the wall thickness tP from one another. FIG. 3 is a graph showing a case in which the wall thickness tP is 0.1 mm. FIG. 4 is a graph showing a case in which the wall thickness tP is 0.2 mm. FIG. 5 is a graph showing a case in which the wall thickness tP is 0.3 mm. FIG. 6 is a graph showing a case in which the wall thickness tP is 0.4 mm. In general, in a case in which a hydrofluorocarbon is used as refrigerant, the wall thickness tP from approximately 0.15 to 0.2 mm when Do=5.5 or smaller is often used.

The extra-pipe heat exchange performance of the heat exchanger 100 according to the present embodiment per unit weight as shown in FIGS. 3 to 6 is calculated by the following method.

In general, the heat transfer coefficient αa [W/m²·K] between air and the fins is defined by the following equations.

[Math. 1]

$$\alpha_a = \frac{\lambda_a}{De} Nu$$

$$Nu = C_1 \cdot \left(\frac{Re \cdot Pr \cdot De}{N_L \cdot L_1}\right)^{C_2}$$

$$Re = \frac{U \cdot De}{v}$$

Note here that Nu is a Nusselt number and Re is a Reynolds number. Pr is a Prandtl number, $\lambda_a$ is the thermal conductivity of air, and v is the kinematic viscosity of air. At ordinary temperatures and pressures, Pr=0.72, $\lambda_a$=0.0261 [W/m·K], and v=0.000016 [m²/s]. Further, $C_1$ and $C_2$ are constants, and $N_L$ is the number of rows of the heat transfer pipes.

The characteristic length De [m] is defined by the following equations.

[Math. 2]

$$De = 4 \cdot V_c / A_c$$

$$V_c = (F_p - t_F) \cdot \left(L_1 \cdot L_2 - \frac{\pi \cdot d_c^2}{4}\right)$$

$$d_c = D_o + 2 \cdot t_F$$

Note here that $V_c$ [m³] is a free flow volume, $F_P$ [m] is a fin pitch, $t_F$ [m] is the thickness of each of the fins, and $d_c$ [m] is a fin collar outer diameter.

The wind velocity U [m/s] based on a free passage volume between fins and the front wind velocity $U_f$ [m/s] of the heat exchanger are defined by the following equations.

[Math. 3]

$$U = \frac{F_F \cdot L_2}{A_c} \cdot U_F$$

$$A_c = \frac{V_c}{L_1}$$

$$U_f = \frac{Q_{air}}{EH \cdot EL}$$

Note here that $Q_{air}$ [m³/s] is the flow rate of air flowing into the heat exchanger, EH is the overall height of the heat exchanger in the step direction, and EL is the overall height of the heat exchanger in a direction in which the fins are stacked.

In general, the extra-pipe heat transfer coefficient αo is defined by the following equations.

$$\alpha_o = \left\{ \frac{A_o}{A_P + A_P \cdot \eta} \cdot \frac{1}{\alpha_a} + \frac{A_o}{A_{con}} \cdot \frac{1}{\alpha_c} \right\}^{-1} \quad \text{[Math. 4]}$$

$$A_o = A_P + A_F$$

Note here that η is fin efficiency and aa is an air-side heat transfer coefficient. Ao [$m^2$] is the air-side total heat transfer area of the heat exchanger, $A_p$ [$m^2$] is the air-side pipe heat transfer area of the heat exchanger, $A_F$ [$m^2$] is the air-side fin heat transfer area of the heat exchanger, and $A_{con}$ [$m^2$] is the area of contact between the heat transfer pipes and the fins. Ao, $A_p$, $A_F$, and $A_{con}$ are values that can be calculated once the dimensions dependent on the shape of the heat exchanger, namely the number $N_L$ of rows of heat transfer pipes, the number $N_D$ of steps of heat transfer pipes, the number $N_F$ of fins, the row pitch L1, the step pitch L2, the fin pitch $F_P$, the fin thickness $t_F$, and the outer diameter Do of each of the heat transfer pipes, are determined. The contact heat transfer coefficient $\alpha_c$ between the heat transfer pipes and the fins of the heat exchanger is constant.

The fin efficiency η is defined by the following equations.

$$\eta = \left\{ 1 + \alpha_a \cdot \frac{(d_F - d_c)^2}{6 \cdot \lambda_F \cdot t_F} \cdot \left( \frac{d_F}{d_c} \right)^{0.5} \right\}^{-1} \quad \text{[Math. 5]}$$

$$d_F = \left\{ \frac{4}{\pi} \cdot L_2 \cdot L_1 \right\}^{0.5}$$

Note here that $d_F$ [m] is a fin equivalent diameter and $\lambda_F$ [W/m·K] is the thermal conductivity of the fins.

The ventilation resistance ΔP [Pa] is defined by the following equations.

$$\Delta P = f \cdot \frac{2 \cdot L_1 \cdot N_L \cdot \rho \cdot U^2}{De} \quad \text{[Math. 6]}$$

$$f = C_3 \cdot Re^{C_4} \cdot \left( \frac{De}{L_1 \cdot N_L} \right)^{1+C_4}$$

Note here that f is a coefficient of friction loss, ρ is the density of air, and $C_3$ and $C_4$ are constants.

It should be noted that the constants $C_1$, $C_2$, $C_3$, and $C_4$, which are used in the Nusselt number Nu and a coefficient of flow loss f, are set to represent the thermal conductivity αa and ventilation resistance ΔP of the fins of a heat exchanger of a commercially widely-distributed common air-conditioning apparatus.

The extra-pipe heat exchange performance of the heat exchanger 100 according to the present embodiment per unit weight as shown in FIGS. 3 to 6 is calculated under the following conditions.

[Calculation Conditions]

Dry-bulb temperature of air flowing into heat exchanger 100: 35 degrees Celsius Wet-bulb temperature of air flowing into heat exchanger 100: 24 degrees Celsius Wind velocity at front of heat exchanger 100 of air flowing into heat exchanger 100: 1.2 m/sec Refrigerant: R32

Outer diameter Do of heat transfer pipe: 2.0 mm to 5.5 mm

Wall thickness tP of heat transfer pipe: 0.1 mm to 0.4 mm

Material of heat transfer pipe: copper

Row pitch L1: 11 mm to 22 mm

Step pitch L2: 5 mm to 42 mm

Thickness of fin: 0.10 mm

Fin pitch $F_P$: 1.50 mm

Material of fin: aluminum

Shape of fin: flat fin

As a comparative example, a performance calculation is performed under the following calculation conditions. The other parameters are similar to the aforementioned calculation conditions. The calculation conditions of the comparative example are conditions under which the intra-pipe volume is smallest in Patent Literature 1 (Japanese Unexamined Patent Application Publication No. 2013-92306).

Outer diameter Do of heat transfer pipe: 5.5

Row pitch L1: 20.35 mm

Step pitch L2: 20.35 mm

Fin pitch $F_P$: 1.50 mm

Further, under the calculation conditions of the comparative example, the area ratio B/A is 0.053 in a case in which Wall Thickness tP=0.1 mm, is 0.049 in a case in which Wall Thickness tP=0.2 mm, is 0.046 in a case in which Wall Thickness tP=0.3 mm, and is 0.042 in a case in which Wall Thickness tP=0.4 mm.

As shown in FIGS. 3 to 6, there is a region in which the outer diameter Do of each pipe is less than 5.5 mm, Extra-pipe Heat Exchange Performance/Weight [Ratio] exceeds 100%, and the area ratio B/A can fall below that of the comparative example. That is, if the area ratio B/A falls below that of the comparative example, the intra-pipe volume V can be made smaller than that of the comparative example, and the cost performance of the heat exchanger 100 can be made higher than that of the comparative example.

A range of numerical values of the area ratio B/A in which Extra-pipe Heat Exchange Performance/Weight [Ratio] exceeds 100% and the area ratio B/A can fall below that of the comparative example varies with the outer diameter Do and the wall thickness tP. For example, as shown in FIG. 4, in a case where Wall Thickness tP=0.2 mm and Do=3.0, Extra-pipe Heat Exchange Performance/Weight [Ratio] exceeds 100% and the area ratio B/A falls below that of the comparative example, provided 0.013≤B/A≤0.043. Further, for example, as shown in FIG. 4, in a case where Wall Thickness tP=0.2 mm and Do=4.0, Extra-pipe Heat Exchange Performance/Weight [Ratio] exceeds 100% and the area ratio B/A falls below that of the comparative example, provided 0.023≤B/A≤0.049. Further, for example, as shown in FIG. 5, in a case where Wall Thickness tP=0.3 mm and Do=3.0, Extra-pipe Heat Exchange Performance/Weight [Ratio] exceeds 100% and the area ratio B/A falls below that of the comparative example, provided 0.009≤B/A≤0.033.

An upper limit of the range of numerical values of the area ratio B/A in which the outer diameter Do of each pipe is less than 5.5 mm, Extra-pipe Heat Exchange Performance/Weight [Ratio] exceeds 100%, and the area ratio B/A can fall below that of the comparative example, shown in FIGS. 3 to 6, is expressed by Formula (1) below as a function of the outer diameter Do and the wall thickness tP. Further, a lower limit of the range of numerical values of the area ratio B/A in which Extra-pipe Heat Exchange Performance/Weight [Ratio] exceeds 100% and the area ratio B/A can fall below that of the comparative example, shown in FIGS. 3 to 6, is expressed by Formula (2) below as a function of the outer diameter Do and the wall thickness tP.

$$F(Do,tP)=(0.0219\times tP^2-0.0185\times tP+0.0043)\times ln(Do)+(1.6950\times tP^2+1.8455\times tP+1.5416)$$ Formula (1): Upper Limit Function It should be noted that ln is a natural logarithm whose base is e.

$$G(Do,tP)=(0.2076\times tP^2-0.1480\times tP+0.0545)\times Do\hat{}(-0.0021\times tP^2-0.0528\times tP+0.0164)$$ Formula (2): Lower Limit Function Further, the area ratio B/A of the comparative example is expressed by Formula (3) below as a function of the wall thickness tP.

$$H(tP)=0.0076\times tP^2-0.0417\times tP+0.0574$$ Formula (3): Area Ratio Function of Comparative Example The upper limit function F (Do, tP) is an approximate expression calculated, for example, by a logarithmic approximation of the method of least squares after obtaining, for each wall thickness tP and each outer diameter Do, an upper limit value of the range of numerical values of the area ratio B/A in which Extra-pipe Heat Exchange Performance/Weight [Ratio] exceeds 100% and the area ratio B/A can fall below that of the comparative example. Further, the lower limit function G (Do, tP) is an approximate expression calculated, for example, by a power approximation of the method of least squares after obtaining, for each wall thickness tP and each outer diameter Do, an upper limit value of the range of numerical values of the area ratio B/A in which Extra-pipe Heat Exchange Performance/Weight [Ratio] exceeds 100% and the area ratio B/A can fall below that of the comparative example. Further, the area ratio function H (tP) of the comparative example is an approximate expression calculated, for example, by a power approximation of the method of least squares after obtaining a value of the area ratio B/A of the comparative example for each wall thickness tP.

With Formulas (1) to (3) above, a relationship among the outer diameter Do, the area ratio B/A, and the wall thickness tP in which Extra-pipe Heat Exchange Performance/Weight [Ratio] exceeds 100% and the area ratio B/A can fall below that of the comparative example is expressed by Formula (4) below.

$$Do<5.5\text{ mm},$$

$$(0.2076\times tP^2-0.1480\times tP+0.0545)\times Do\hat{}(-0.0021\times tP^2-0.0528\times tP+0.0164)\leq B/A\leq(0.0219\times tP^2-0.0185\times tP+0.0043)\times ln(Do)+(1.6950\times tP^2+1.8455\times tP+1.5416),\text{ and}$$

$$B/A<0.0076\times tP^2-0.0417\times tP+0.0574$$ Formula (4)

Specific examples of the range of numerical values identified by Formula (4) above under the aforementioned calculation conditions are described here with reference to FIGS. 13 to 16.

FIGS. 13 to 16 are each a graph showing a relationship between the outer diameter Do of each of the heat transfer pipes and the area ratio B/A in the heat exchanger 100 according to Embodiment 1. In each of FIGS. 13 to 16, the vertical axis of the graph represents the area ratio B/A of the area B to the area A. The horizontal axis of the graph represents the outer diameter Do of each of the heat transfer pipes.

Figure 13:
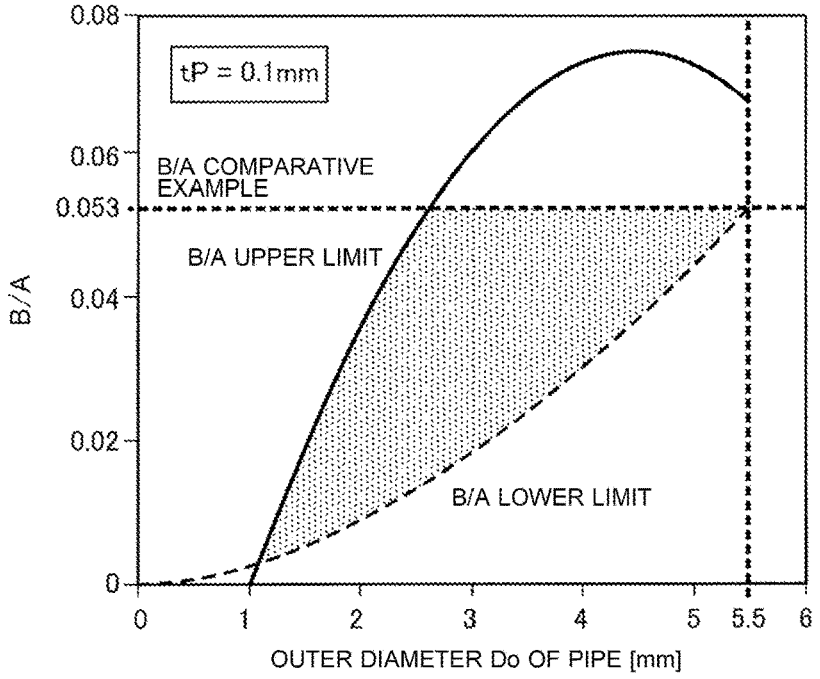
FIG. 13 is a graph showing a relationship between the outer diameter Do of each heat transfer pipe and the area ratio B/A in the heat exchanger 100 according to Embodiment 1.
Figure 14:
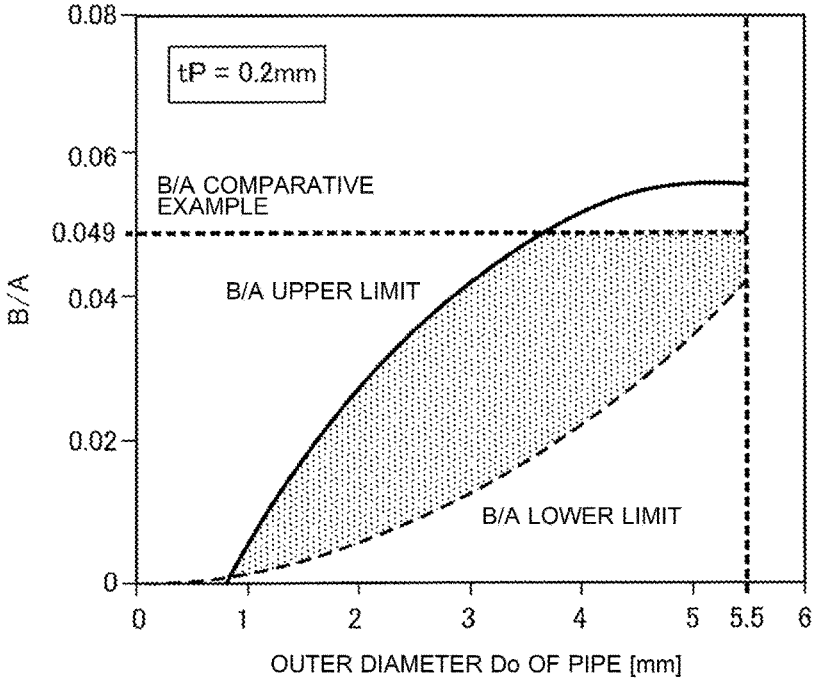
FIG. 14 is a graph showing a relationship between the outer diameter Do of each heat transfer pipe and the area ratio B/A in the heat exchanger 100 according to Embodiment 1.
Figure 15:
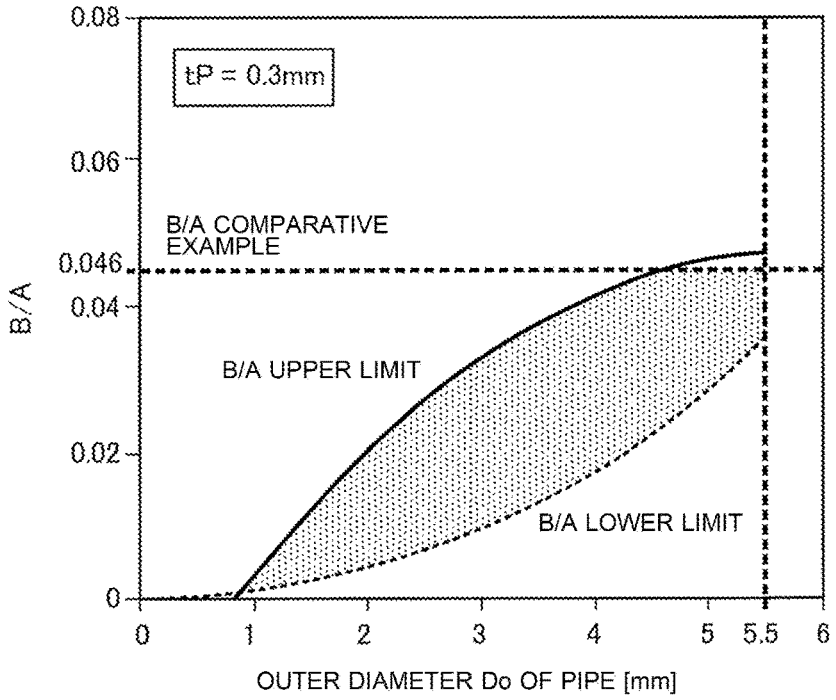
FIG. 15 is a graph showing a relationship between the outer diameter Do of each heat transfer pipe and the area ratio B/A in the heat exchanger 100 according to Embodiment 1.
Figure 16:
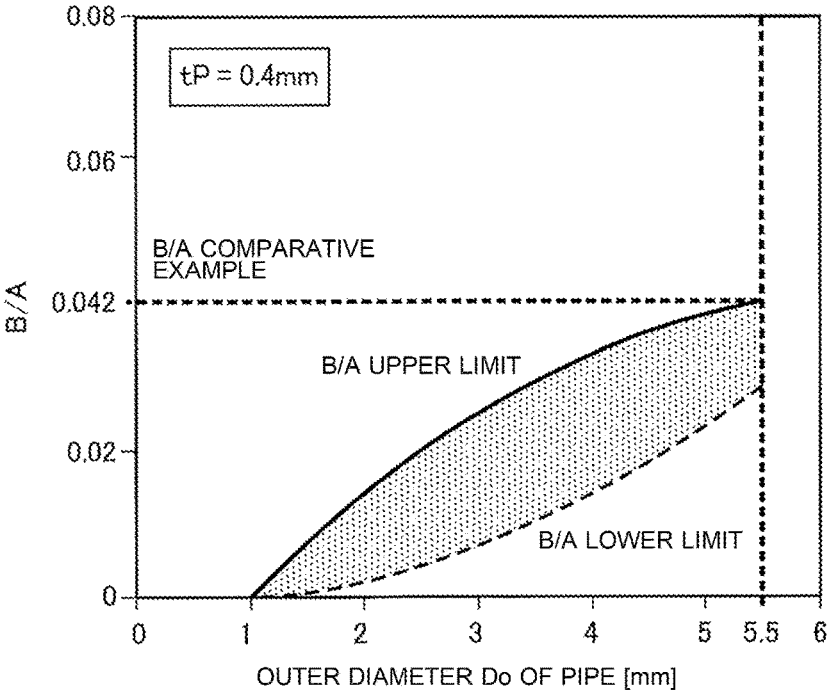
FIG. 16 is a graph showing a relationship between the outer diameter Do of each heat transfer pipe and the area ratio B/A in the heat exchanger 100 according to Embodiment 1.

In each of FIGS. 13 to 16, the upper limit function F (Do, tP) is shown as "B/A UPPER LIMIT". Further, the lower limit function G (Do, tP) is shown as "B/A LOWER LIMIT". Further, the area ratio function H (tP) of the comparative example is shown as "B/A COMPARATIVE EXAMPLE". FIGS. 13 to 16 vary in value of the wall thickness tP from one another. FIG. 13 is a graph showing a case in which the wall thickness tP is 0.1 mm. FIG. 14 is a graph showing a case in which the wall thickness tP is 0.2 mm. FIG. 15 is a graph showing a case in which the wall thickness tP is 0.3 mm. FIG. 16 is a graph showing a case in which the wall thickness tP is 0.4 mm.

As shown in FIGS. 13 to 16, at each wall thickness tP, Extra-pipe Heat Exchange Performance/Weight [Ratio] exceeds 100% and the area ratio B/A can fall below that of the comparative example, provided the outer diameter Do and the area ratio B/A fall within the range greater than or equal to "B/A LOWER LIMIT", less than or equal to "B/A UPPER LIMIT", and less than "B/A COMPARATIVE EXAMPLE" and the outer diameter Do falls within the range of Do<5.5 mm. That is, the intra-pipe volume V can be made smaller than that of the comparative example, and the cost performance of the heat exchanger 100 can be made higher than that of the comparative example.

As noted above, configuring the heat exchanger 100 such that when Outer Diameter Do<5.5 mm, Lower Limit Function G (Do, tP)≤Area Ratio B/A≤Upper Limit Function F (Do, tP) and Area Ratio B/A<Area Ratio Function H (tP) of Comparative Example allows the amount of refrigerant charge to fall below that of the comparative example while allowing Extra-pipe Heat Exchange Performance/Weight [Ratio] to exceed 100%. This in turn makes it possible to improve heat exchanger performance while reducing the inner capacity of each of the heat transfer pipes of the heat exchanger 100. Therefore, the heat exchanger 100 according to the present embodiment can achieve both improvement in cost performance and a reduction in total value of GWP through a reduction in amount of refrigerant charge. As a result, this makes it possible to reduce the amount of refrigerant charge while improving energy-saving effectiveness in a refrigeration cycle apparatus including the heat exchanger 100.

Further, the foregoing calculation conditions of the heat exchanger 100 according to the present embodiment correspond to cooling rated conditions of an air-conditioning apparatus serving as an example of a refrigeration cycle apparatus. This makes it possible to, under the cooling rated conditions of an air-conditioning apparatus, reduce the amount of refrigerant charge while improving energy-saving effectiveness. It should be noted that even under other conditions such as cooling intermediate conditions, heating rated conditions, and heating intermediate conditions of an air-conditioning apparatus serving as an example of a refrigeration cycle apparatus, the heat exchanger 100 according to the present embodiment brings about effects that are similar to those brought about under the cooling rated conditions.

Embodiment 2

Figure 17:
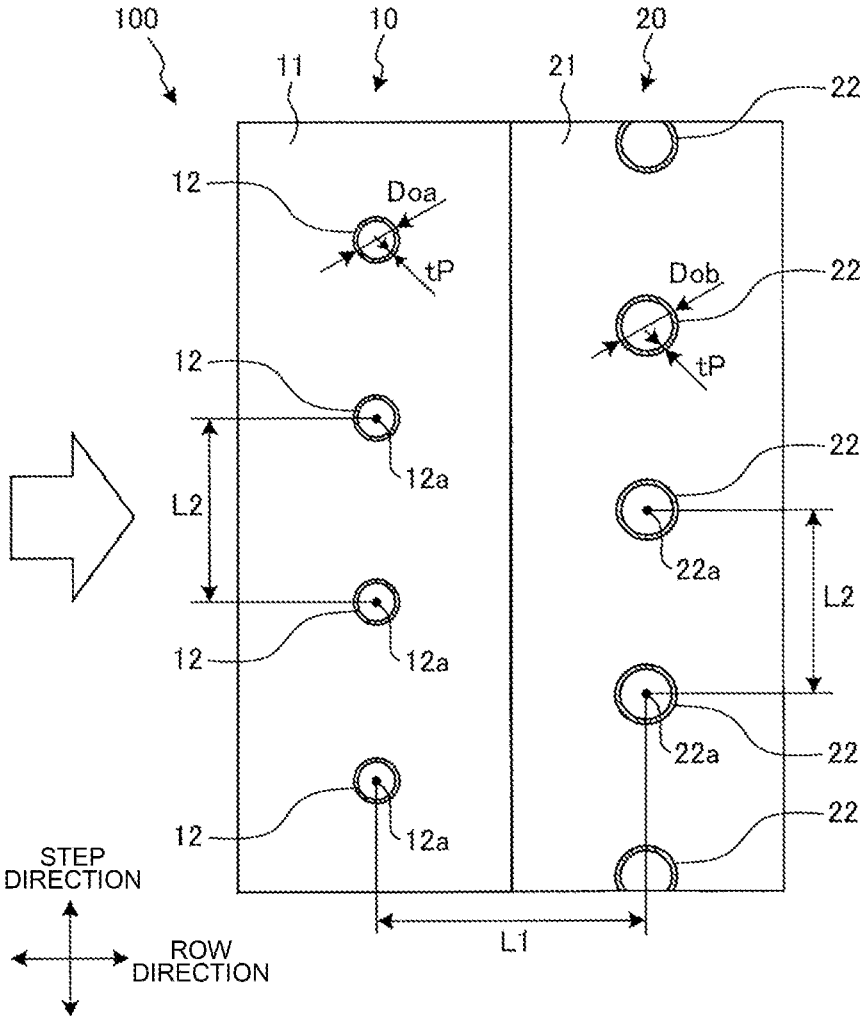
FIG. 17 is a cross-sectional view showing a configuration of some components of a heat exchanger 100 according to Embodiment 2.

A heat exchanger according to Embodiment 2 is described. FIG. 17 is a cross-sectional view showing a configuration of some components of a heat exchanger 100 according to the present embodiment. As with FIG. 1, FIG. 17 shows a configuration of the heat exchanger 100 as sectioned along the plane perpendicular to the direction in which the first heat transfer pipes 12 extend. Constituent elements having the same functions and workings as those of Embodiment 1 are given the same reference signs, and a description of such constituent elements is omitted.

In the heat exchanger 100 of the present embodiment, as shown in FIG. 17, the outer diameter Doa of each of the first heat transfer pipes 12 of the first heat exchange unit 10 located furthest windward is smaller than the outer diameter Dob of each of the second heat transfer pipes 22 of the second heat exchange unit 20 (Doa<Dob). A step pitch L2 between first heat transfer pipes 12 is identical to a step pitch L2 between second heat transfer pipes 22. Further, each of the plurality of first heat transfer pipes 12 is a circular pipe having a wall thickness tP that is equal to the wall thickness of a second heat transfer pipe 22.

In both the first heat exchange unit 10 and the second heat exchange unit 20, the relation of Formula (4), which is described above in Embodiment 1, is satisfied. Further, a value of B/A in the first heat exchange unit 10 is smaller than a value of B/A in the second heat exchange unit 20.

Figure 18:
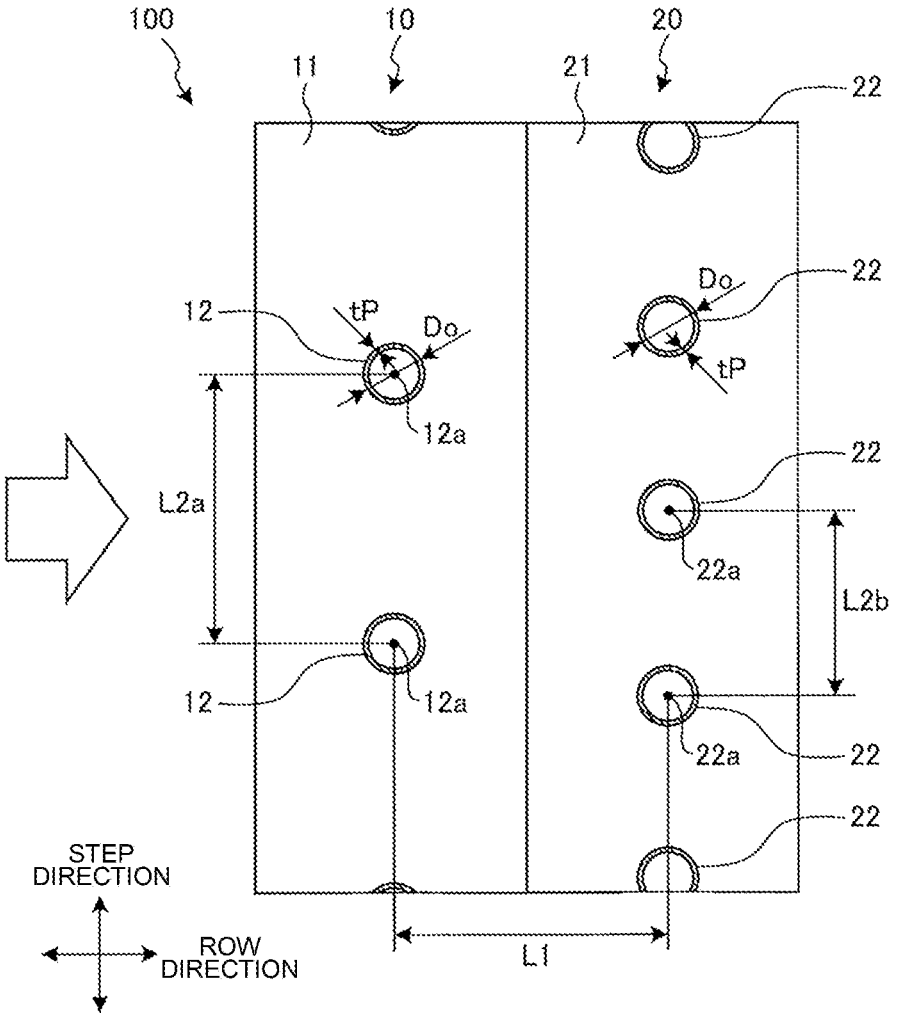
FIG. 18 is a cross-sectional view showing a configuration of some components of a heat exchanger 100 according to a modification of Embodiment 2.

FIG. 18 is a cross-sectional view showing a configuration of some components of a heat exchanger 100 according to a modification of the present embodiment. In the heat exchanger 100 of the present modification, as shown in FIG. 18, a step pitch L2*a* between first heat transfer pipes 12 of the first heat exchange unit 10 located furthest windward is greater than a step pitch L2*b* between second heat transfer pipes 22 of the second heat exchange unit 20 (L2*a*>L2*b*). The outer diameter Do of each of the first heat transfer pipes 12 is identical to the outer diameter Do of each of the second heat transfer pipes 22. Further, each of the plurality of first heat transfer pipes 12 is a circular pipe having a wall thickness tP that is equal to the wall thickness of a second heat transfer pipe 22.

In both the first heat exchange unit 10 and the second heat exchange unit 20, the relation of Formula (4), which is described above in Embodiment 1, is satisfied. Further, a value of B/A in the first heat exchange unit 10 is smaller than a value of B/A in the second heat exchange unit 20.

As described above, the heat exchanger 100 according to the present embodiment further includes a plurality of heat exchange units, arrayed along the direction of airflow, each of which has one or more of the plurality of heat transfer pipes. The plurality of heat exchange units include a first heat exchange unit 10 located furthest windward and at least one second heat exchange unit 20 located further leeward than the first heat exchange unit 10. A value of B/A in the first heat exchange unit 10 is smaller than a value of B/A in the at least one second heat exchange unit 20.

In general, in the first heat exchange unit 10 located furthest windward, frost easily forms, as a great temperature difference between the first fins 11 or the first heat transfer pipes 12 and air results in an increased amount of heat that is exchanged. The foregoing configuration makes it possible to make the first heat exchange unit 10 lower in heat exchange performance than the second heat exchange unit 20. This makes it possible to inhibit the formation of frost in the first heat exchange unit 10 and therefore makes it possible to prevent an air trunk of the first heat exchange unit 10 from being closed by an increased amount of frost that is formed. This makes it possible to improve cost performance while reducing deterioration in ventilation performance of the heat exchanger 100.

Embodiment 3

Figure 19:
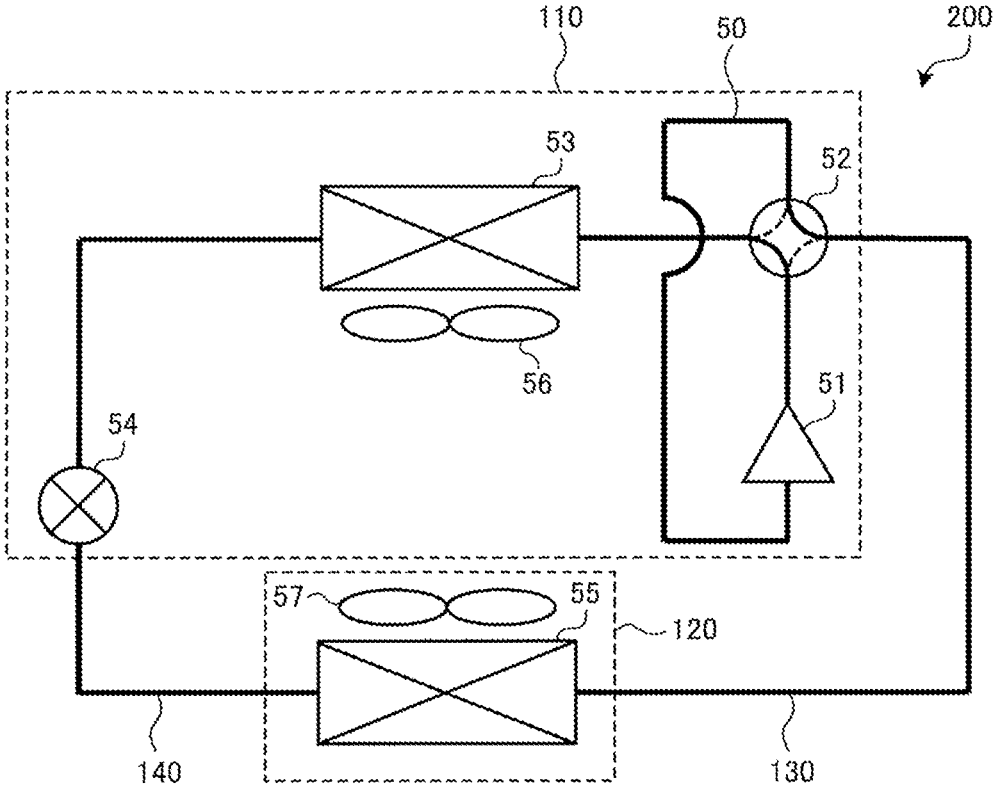
FIG. 19 is a refrigerant circuit diagram showing a configuration of a refrigeration cycle apparatus 200 according to Embodiment 3.

A refrigeration cycle apparatus according to Embodiment 3 is described. FIG. 19 is a refrigerant circuit diagram showing a configuration of a refrigeration cycle apparatus 200 according to Embodiment 3. In the present embodiment, an air-conditioning apparatus is an example of the refrigeration cycle apparatus 200. As shown in FIG. 19, the refrigeration cycle apparatus 200 includes a refrigeration cycle circuit 50 through which refrigerant circulates. The refrigeration cycle circuit 50 is configured such that a compressor 51, a four-way valve 52, an outdoor heat exchanger 53, an expansion valve 54, and an indoor heat exchanger 55 are connected in a circular pattern via refrigerant pipes. Further, the refrigeration cycle apparatus 200 includes an outdoor fan 56 configured to supply air to the outdoor heat exchanger 53 and an indoor fan 57 configured to supply air to the indoor heat exchanger 55. In the refrigeration cycle apparatus 200, the compressor 51 is driven so that a refrigeration cycle is executed in which the refrigerant circulates through the refrigeration cycle circuit 50 while the refrigerant changes its phase. The outdoor heat exchanger 53 allows the air supplied by the outdoor fan 56 and the refrigerant, which is an inner fluid, to exchange heat with each other. The indoor heat exchanger 55 allows the air supplied by the indoor fan 57 and the refrigerant, which is an inner fluid, to exchange heat with each other. As at least either the outdoor heat exchanger 53 or the indoor heat exchanger 55, the heat exchanger 100 of Embodiment 1 or 2 is used.

The refrigeration cycle apparatus 200 includes an outdoor unit 110 and an indoor unit 120 as heat exchange units. The outdoor unit 110 houses the compressor 51, the four-way valve 52, the outdoor heat exchanger 53, the expansion valve 54, and the outdoor fan 56. The indoor unit 120 houses the indoor heat exchanger 55 and the indoor fan 57. The outdoor unit 110 and the indoor unit 120 are connected to each other via a gas pipe 130 and a liquid pipe 140, which are some of the refrigerant pipes.

Operation of the refrigeration cycle apparatus 200 is described by describing cooling operation as an example. For cooling operation, the four-way valve 52 is switched such that refrigerant discharged from the compressor 51 flows into the outdoor heat exchanger 53. The high-pressure gas refrigerant discharged from the compressor 51 flows into the outdoor heat exchanger 53 via the four-way valve 52. During cooling operation, the outdoor heat exchanger 53 operates as a condenser. That is, the outdoor heat exchanger 53 allows refrigerant circulating through inside and outdoor air supplied by the outdoor fan 56 to exchange heat with each other, so that the refrigerant transfers heat of condensation to the outdoor air. This causes the gas refrigerant having flowed into the outdoor heat exchanger 53 to condense into high-pressure liquid refrigerant.

The liquid refrigerant having flowed out of the outdoor heat exchanger 53 is decompressed by the expansion valve 54 into low-pressure two-phase refrigerant. The two-phase refrigerant having flowed out of the expansion valve 54 flows into the indoor heat exchanger 55 via the liquid pipe 140. During cooling operation, the indoor heat exchanger 55 operates as an evaporator. That is, the indoor heat exchanger 55 allows refrigerant circulating through inside and indoor air supplied by the indoor fan 57 to exchange heat with each other, so that the refrigerant removes heat of evaporation from the indoor air. This causes the two-phase refrigerant having flowed into the indoor heat exchanger 55 to evaporate into low-pressure gas refrigerant. The indoor air having passed through the indoor heat exchanger 55 is cooled by exchanging heat with the refrigerant. The gas refrigerant having flowed out of the indoor heat exchanger 55 is suctioned into the compressor 51 via the gas pipe 130 and the four-way valve 52. The gas refrigerant suctioned into the compressor 51 is compressed into high-pressure gas refrigerant. During cooling operation, the refrigeration cycle described above is continuously and repeatedly executed. Although not described, for heating operation, a direction of refrigerant flow is switched by the four-way valve 52 such that the outdoor heat exchanger 53 operates as an evaporator and the indoor heat exchanger 55 operates as a condenser.

As described above, the refrigeration cycle apparatus 200 according to the present embodiment includes the heat exchanger 100 of Embodiment 1 or 2. This configuration allows the refrigeration cycle apparatus 200 to achieve both a reduction in total value of GWP and improvement in energy-saving effectiveness.

Embodiments 1 to 3 and the modifications described above may be combined with each other.

The invention claimed is:

1. A heat exchanger, comprising:

a plurality of fins arranged in parallel to each other; and a plurality of heat transfer pipes each extending in a direction intersecting the plurality of fins, in a plane perpendicular to a direction in which the plurality of heat transfer pipes extend, the plurality of heat transfer pipes being placed in a plurality of rows in a row direction that is along a direction of airflow at a row pitch L1, in the plane, the plurality of heat transfer pipes being placed in a plurality of steps in a step direction perpendicular to the row direction at a step pitch L2, where an outer diameter of each of the plurality of heat transfer pipes is defined as Do, a wall thickness of a portion having a smallest distance between an outer wall surface and an inner wall surface of each of the plurality of heat transfer pipes is defined as tP, an area represented by a numerical expression of L1×L2 is defined as A, and an area represented by a numerical expression of $((Do-2\times tP)/2)^2\times\pi$ is defined as B, a relation of Do<5.5 mm, a relation of $(0.2076\times tP^2-0.1480\times tP+0.0545)\times Do\hat{}(-0.0021\times tP^2-0.0528\times tP+0.0164)\leq B/A\leq(0.0219\times tP^2-0.0185\times tP+0.0043)\times \ln(Do)+(1.6950\times tP^2+1.8455\times tP+1.5416)$, and a relation of $B/A<0.0076\times tP^2-0.0417\times tP+0.0574$ being satisfied.

2. The heat exchanger of claim 1, further comprising a plurality of heat exchange units, arrayed along the direction of airflow, each of which has one or more of the plurality of heat transfer pipes, wherein the plurality of heat exchange units include a first heat exchange unit located furthest windward and at least one second heat exchange unit located further leeward than the first heat exchange unit, and a value of B/A in the first heat exchange unit is smaller than a value of B/A in the at least one second heat exchange unit.

3. A refrigeration cycle apparatus, comprising the heat exchanger of claim 1.

* * * * *